US007459619B2

(12) United States Patent
Gawenda

(10) Patent No.: US 7,459,619 B2
(45) Date of Patent: Dec. 2, 2008

(54) TREMOLO MECHANISM FOR GUITAR

(76) Inventor: Philipp Hubert Gawenda, 258 Rancho Viejo Blvd., Brownsville, TX (US) 78526

( * ) Notice: Subject to any disclaimer, the term of this patent is extended or adjusted under 35 U.S.C. 154(b) by 0 days.

(21) Appl. No.: 11/592,122

(22) Filed: Nov. 3, 2006

(65) Prior Publication Data

US 2007/0169609 A1 Jul. 26, 2007

Related U.S. Application Data

(60) Provisional application No. 60/761,020, filed on Jan. 23, 2006.

(51) Int. Cl.
*G10D 3/00* (2006.01)

(52) U.S. Cl. ..... 84/313; 84/313

(58) Field of Classification Search ..... 84/313
See application file for complete search history.

(56) References Cited

U.S. PATENT DOCUMENTS

| | | | | | |
|---|---|---|---|---|---|
| 3,124,991 | A * | 3/1964 | Costen | 84/267 |
| 3,500,711 | A * | 3/1970 | Fender | 84/313 |
| 4,457,201 | A * | 7/1984 | Storey | 84/313 |
| 4,512,232 | A * | 4/1985 | Schaller | 84/313 |
| 4,608,905 | A * | 9/1986 | Takabayashi | 84/313 |
| 4,656,915 | A * | 4/1987 | Osuga | 84/313 |
| 4,944,208 | A * | 7/1990 | Kusek | 84/313 |
| 5,429,028 | A * | 7/1995 | Fisher, IV | 84/313 |
| D361,779 | S * | 8/1995 | Lambert, Jr. | D17/21 |
| 5,477,765 | A * | 12/1995 | Dietzman | 84/313 |
| 5,481,955 | A * | 1/1996 | Goto | 84/313 |
| 5,520,082 | A * | 5/1996 | Armstrong et al. | 84/313 |
| 5,986,190 | A * | 11/1999 | Wolff et al. | 84/297 R |
| 6,384,311 | B1 * | 5/2002 | Cota | 84/739 |
| 6,420,639 | B1 * | 7/2002 | Sherlock | 84/313 |
| 6,875,911 | B2 * | 4/2005 | Schryer | 84/313 |
| 6,972,360 | B1 * | 12/2005 | Ekin | 84/312 R |
| 7,049,504 | B1 * | 5/2006 | Galoyan | 84/739 |
| 2002/0043147 | A1 * | 4/2002 | Herbold | 84/313 |
| 2007/0169609 | A1 * | 7/2007 | Gawenda | 84/322 |
| 2008/0072735 | A1 * | 3/2008 | Kahler | 84/313 |

* cited by examiner

*Primary Examiner*—Walter Benson
*Assistant Examiner*—Robert W Horn
(74) *Attorney, Agent, or Firm*—Andrews Kurth LLP

(57) ABSTRACT

An improved tremolo mechanism for a guitar. The tremolo mechanism for a guitar includes a rotary assembly. The rotary assembly includes a main rotor that includes an arcuate shaped surface defining holes through which a plurality of guitar strings exit the main rotor when the tremolo mechanism is installed on a guitar, resilient means coupled to said main rotor to bias said rotary assembly to a first position at which no tremolo effect is provided and away from a second position at which a tremolo effect is provided and fixing means on the main rotor for securing one end of each of the plurality of guitar strings to the rotary assembly. The tremolo mechanism also includes a plurality of tension rollers for providing rotational tension to said guitar strings. Said arcuate shaped surface directionally guides said strings transverse of said rotary assembly to the tension rollers.

19 Claims, 9 Drawing Sheets

TREMOLO MECHANISM FOR GUITAR

CROSS-REFERENCE TO RELATED APPLICATION(S)

This application claims the priority of U.S. Provisional Application Ser. No. 60/761,020, filed Jan. 23, 2006, entitled "TORSION TREMOLO FOR GUITAR", which is hereby incorporated by reference in its entirety.

BACKGROUND

1. Field of Invention

The present invention relates to improved tremolo assembly for an electric guitar which can replace a standard type tailpiece without modifying the structure of said guitar.

2. Description of Prior Art

Of most tremolo mechanisms for guitar, there are three types which can replace a standard tailpiece with little or no modification to the body of a guitar.

With reference to FIG. 2, the first is a stop-tail piece tremolo mechanism consisting of a standard stop-tailpiece with an attached tremolo arm which is assembled to a pivoting bar and a small spring (not shown) which is affixed between the base of the tremolo arm and the stop-tailpiece. The strings are attached to the pivoting bar. When the tremolo arm is pressed down, the distance between the fixing of the strings and the length of the guitar body shortens, producing a mild tremolo effect. A limitation of this type of tremolo mechanism is that the harmony will decrease by only one half-step at most.

With reference to FIG. 3, the second type of tremolo mechanism, which includes a combined bridge and tailpiece assembly, consists of a tailpiece block which is secured to the body portion of a guitar and an elongated tailpiece member rotatably connected at its ends with the tailpiece block for rotation in one direction about an axis eccentrically, horizontally and vertically offset from the longitudinal axis of the tailpiece member to provide cam action. Adjustable string attachment devices are connected with the tailpiece member for attachment to the ends of the guitar strings which, when tensioned, normally bias the tailpiece member in one direction of rotation. The tailpiece member is spring biased in the other direction of rotation to resist the rotating force exerted on the tailpiece member by the tensioned strings, and at least one lever is connected with the tailpiece member for rotating the same relative to the tailpiece block during sounding of the guitar to produce a tremolo effect.

A limitation becomes clear in this as the tailpiece member is pushed down with the attached tremolo arm, which provides a cam action relative to the tailpiece bock during rotation and the front edge (not shown) recedes below the tailpiece block which requires the routing of a space equal in length, width and thickness of said tailpiece member and attached springs (not shown) into the guitar body itself. Altering a guitar body to accommodate improvements in hardware may not be desirable if said guitar were valuable or a vintage collectable guitar. Making these necessary alterations may thus lessen the value of a guitar.

Another limitation is that many guitars with a standard style tailpiece vary in distance to the intonation bridge whose purpose is to set the height and most importantly the correct intonation of the strings, which thus makes this type of tremolo unsuitable for many guitars.

Yet another limitation of the above mentioned tremolo mechanisms are their use of springs to achieve a tremolo effect. These tremolo mechanisms depend on spring force to return a harmonized chord to its original position after the tremolo arm is pressed and released and are thus subject to variables such as quality, wear and changes in temperature.

With reference to FIG. 4, a third type of tremolo mechanism provides a tremolo effect for each string according to the variations in string diameter, the rate of elongation of the strings and their materials, and also according to the wishes of the player, to provide a tremolo mechanism that can give a harmonized chord, for instance by temporarily changing the tension in all strings stretched between the headstock and a body of a guitar. A member rotates around a shaft (not shown) when tremolo arm is pressed toward the guitar body. The shaft has its axis positioned transversely to the strings. The shaft is constructed so as to resiliently twist as member rotates. Member is provided with a portion against which the strings press. Portion is positioned between a bridge which supports each of the strings and a fixing part which attaches the end of each string to the front of the guitar body. Fixing part is connected to member and rotates along with it. Fixing part includes means, individual to each string, for changing the distance from the axis of the shaft to the point at which each string contacts portion. Consequently, as member is rotated, it is possible to change the tension in each of the strings.

A limitation of this tremolo mechanism is the required removal of both tailpiece, bridge and each respective stud. In addition, four separate holes have to be drilled into the guitar body to affix this tremolo mechanism to the guitar body with screws. Altering a guitar body to accommodate improvements in hardware may not be desirable if said guitar were valuable or a vintage collectable guitar.

Another limitation becomes apparent during installation, as the base of the assembly requires a flat surface, while many guitar tops have a contoured or oval surface.

SUMMARY

An advantage of the embodiments described herein is that they overcome the disadvantages of the prior art. Another advantage of certain embodiments is that they provide an improved tremolo mechanism which can replace a standard tailpiece on a guitar and is capable of providing a tremolo effect for all strings. Another advantage of certain embodiments is that they provide a tremolo mechanism in which the tension of the tremolo arm can be adjusted by a threaded pin. Still another advantage of certain embodiments is that they provide a basic tremolo mechanism that can be used without a spring (which is normally provided in a conventional tremolo mechanism). Yet another advantage of certain embodiments is that they provide a tremolo mechanism which can be adapted to any guitar with a standard tailpiece with out modifying the structure of the guitar.

These advantages and others may be achieved by a tremolo mechanism for a guitar that includes a rotary assembly. The rotary assembly includes a main rotor that includes an arcuate shaped surface defining holes through which a plurality of guitar strings exit the main rotor when the tremolo mechanism is installed on a guitar, resilient means coupled to said main rotor to bias said rotary assembly to a first position at which no tremolo effect is provided and away from a second position at which a tremolo effect is provided and fixing means on the main rotor for securing one end of each of the plurality of guitar strings to the rotary assembly. The tremolo mechanism also includes a plurality of tension rollers for providing rotational tension to said guitar strings. Said arcuate shaped surface directionally guides said strings transverse of said rotary assembly to the tension rollers.

These advantages and others may also be achieved by a tremolo mechanism for a string instrument that includes a rotary assembly. The rotary assembly includes a main rotor that defines holes through which a plurality of strings exit the main rotor when the tremolo mechanism is installed on a string instrument, a torsion bar coupled to said main rotor to bias said rotary assembly to a first position at which no tremolo effect is provided and away from a second position at which a tremolo effect is provided, and fixing holes defined by rear of the main rotor for securing one end of each of the plurality of strings to the rotary assembly. The tremolo mechanism also includes a plurality of tension rollers for providing rotational tension to said strings. Said main rotor directionally guides said strings transverse of said rotary assembly to the tension rollers.

These advantages and others may also be achieved by a guitar capable of producing a tremolo affect that includes a guitar body, a plurality of guitar strings, a plurality of tuning pegs, a guitar bridge, and an improved tremolo mechanism. The tremolo mechanism includes a rotary assembly that includes a main rotor that defines holes through which the plurality of guitar strings exit the main rotor, a torsion bar coupled to said main rotor to bias said rotary assembly to a first position at which no tremolo effect is provided and away from a second position at which a tremolo effect is provided, and fixing holes defined by rear of the main rotor for securing one end of each of the plurality of guitar strings to the rotary assembly. The tremolo mechanism also includes a plurality of tension rollers for providing rotational tension to said guitar strings. Said main rotor directionally guides said guitar strings transverse of said rotary assembly to the tension rollers and said guitar strings are stretched over the guitar bridge and continue along the length of the guitar body to the plurality of tuning pegs.

DESCRIPTION OF THE DRAWINGS

The detailed description will refer to the following drawings, wherein like numerals refer to like elements, and wherein.

DETAILED DESCRIPTION

Described herein are embodiments of an improved tremolo mechanism. Embodiments provide an improved tremolo mechanism which can replace a standard tailpiece on a guitar and is capable of providing a tremolo effect for all strings. The embodiments described herein provide, as shown in FIG. 1, a tremolo mechanism for a guitar which gives a tremolo effect by temporarily changing the tension in strings stretched between the string fixing and the length of a guitar.

Figure 1:
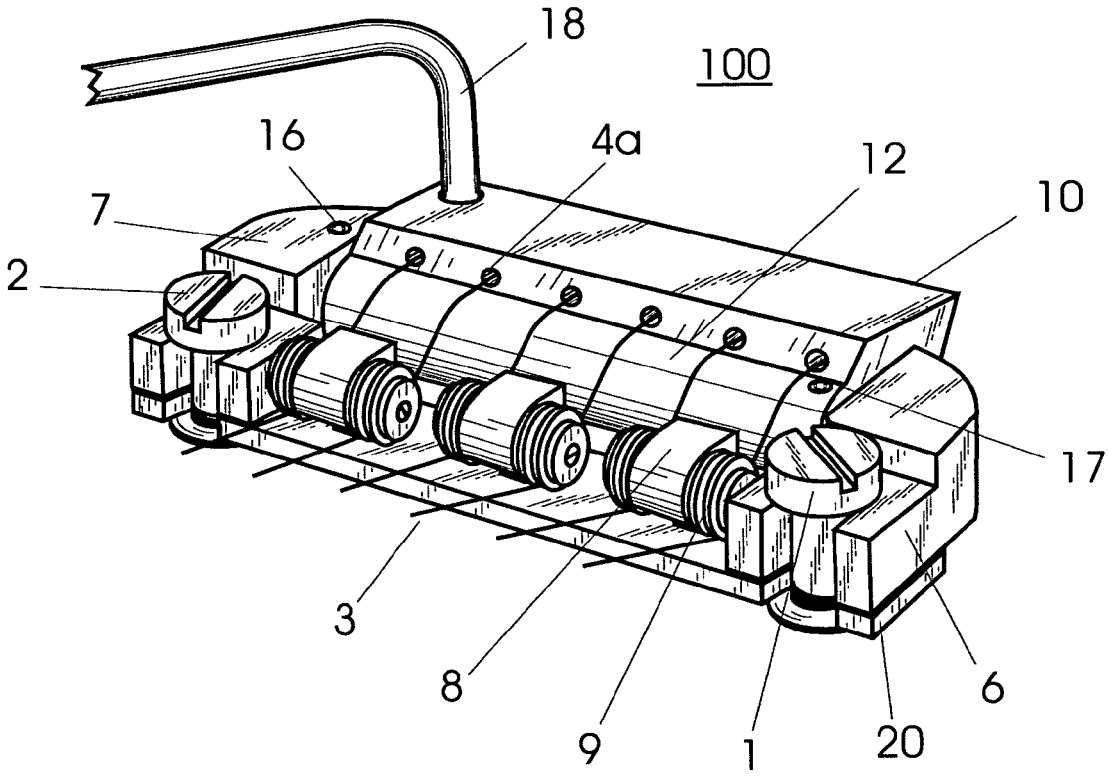
FIG. 1 is a schematic view of the construction of the whole of an embodiment of an improved tremolo mechanism.
Figure 2:
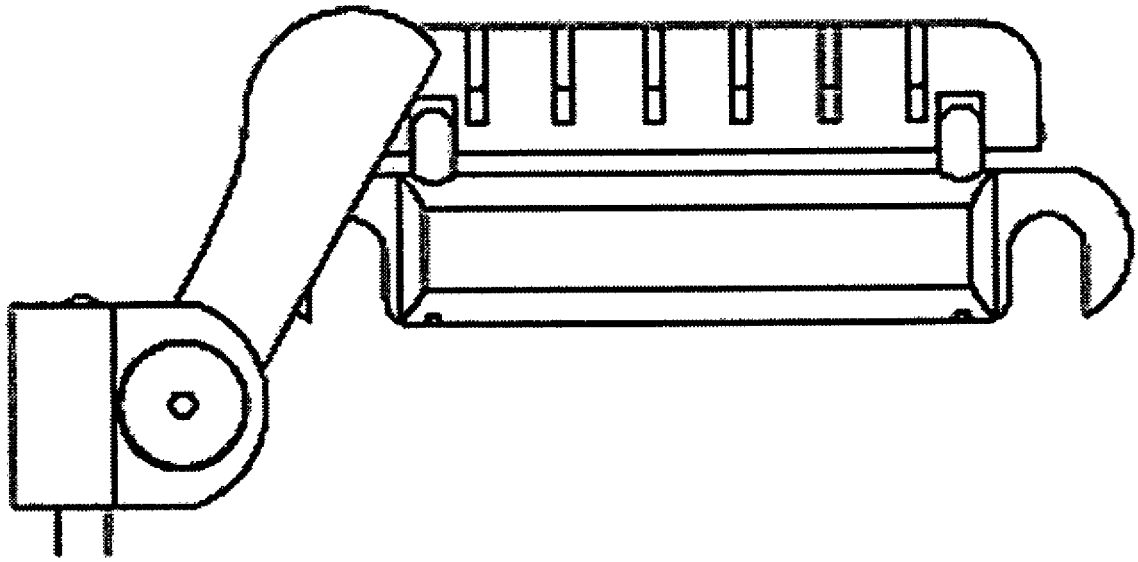
FIG. 2 is a side view schematic of a spring loaded stop-tailpiece tremolo mechanism.
Figure 3:
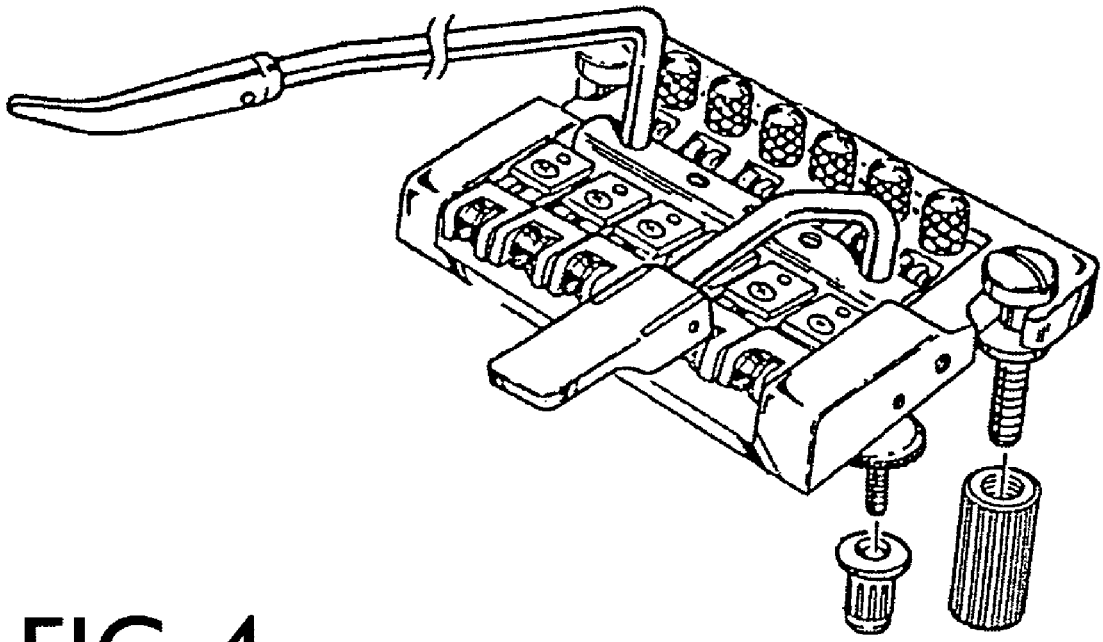
FIG. 3 is a perspective view of another spring loaded tremolo mechanism.
Figure 4:
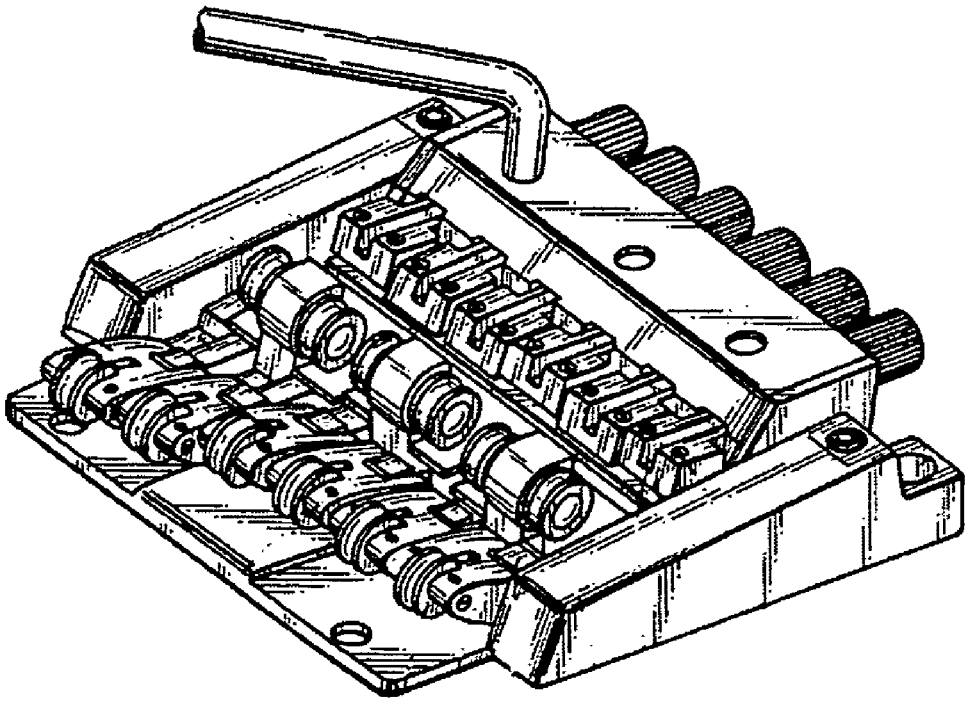
FIG. 4 is a perspective view of a non-spring loaded tremolo mechanism.

With reference now to FIG. 1, shown is a perspective view of an embodiment of improved tremolo mechanism or device 100. Tremolo mechanism 100 includes rotary assembly 10 and press plate/pressboard 20. Rotary assembly 10 includes a tremolo arm 18 attached thereto. Rotary assembly 10 is placed above press plate 20, which includes six tension rollers 9 disposed thereon. Tension rollers 9 are fastened to three brackets 8 attached to press plate 20 and below which guitar strings 3 are placed. Guitar strings 3 are inserted into fixing holes 4 (not shown in FIG. 1) in rear of rotational mechanism, exiting through exit holes 4*a* in the front of rotary assembly 10, following arcuate slope 12 of the front of rotary assembly 10, and threaded underneath tension rollers 9. Tremolo mechanism 100 further includes threaded pins 16, 17, which are discussed below.

Tremolo mechanism 100 may be fastened to stud screws 1, 2 with frame brackets 6, 7. Stud screws 1, 2 secure tremolo mechanism 100 to guitar body 5 (not shown in FIG. 1). Existing tailpiece stud screws 1, 2 from guitar may be used.

Figure 5:
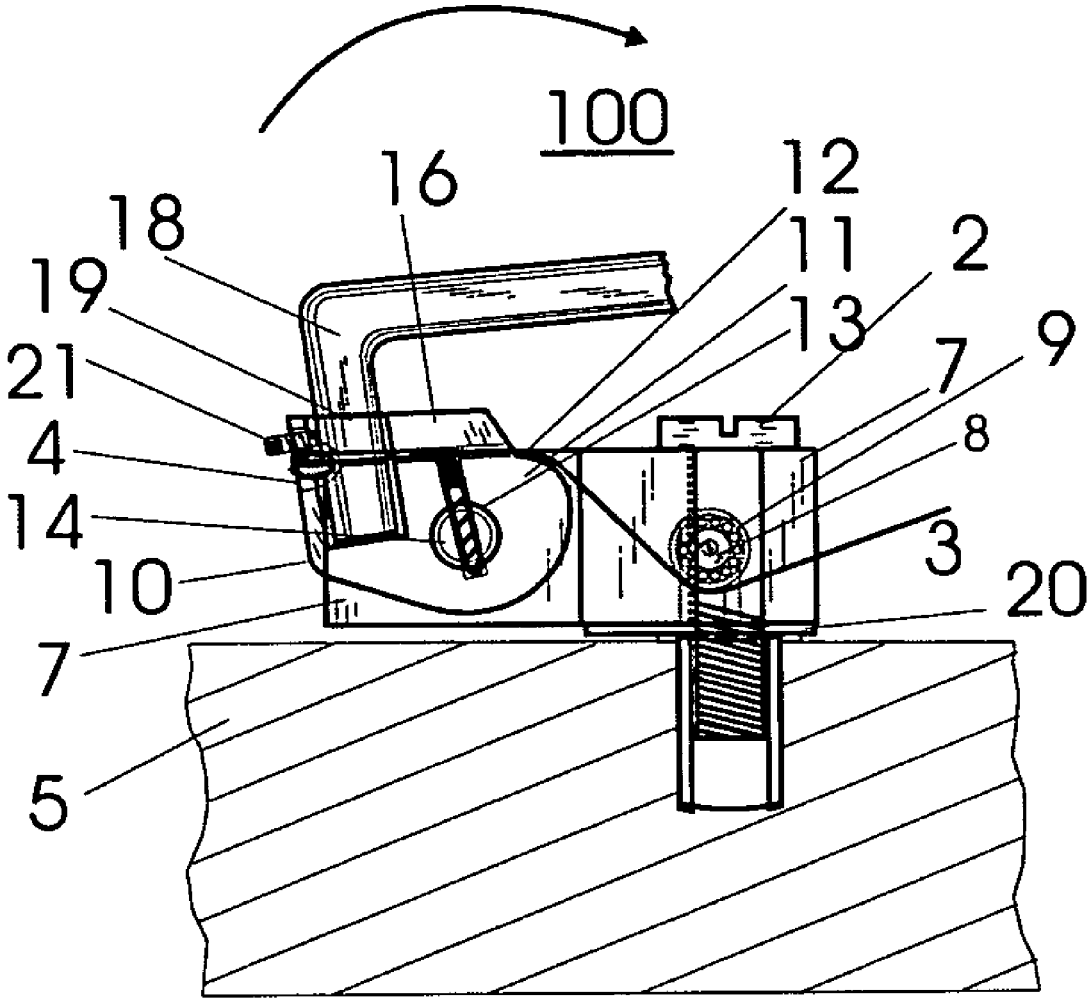
FIG. 5 is a cross-sectional side elevation view of an embodiment of an improved tremolo mechanism.

With reference now to FIG. 5, shown is a cross-sectional view of an embodiment of improved tremolo mechanism 100. Tremolo mechanism 100 is attached to a guitar body 5 via stud screw 2 and stud screw 1 (not shown in FIG. 5). Guitar string 3 is inserted into a fixing hole 4 in rotary assembly 10. Guitar string 3 exits out the front of rotary assembly 10 traversing arcuate slope 12 and is threaded under tension roller 9 which is attached to press plate 20 via bracket 8. Rotary assembly 10 includes torsion bar (or rod) 14 affixed on first end to frame bracket 7 with threaded pin 16, as shown in FIG. 5, and affixed on opposite, second end with threaded pin 17 to rotary assembly 10 (not shown in FIG. 5). Consequently, when downward force is exerted on tremolo arm 18, rotary assembly 10 rotates in the direction of the arrow. Tremolo arm 18 may be pivoted to a desired position by the guitar player. Tremolo arm 18 can be tightened with threaded pin 21 in order to restrict the pivoting motion so that tremolo arm 18 will remain the desired position.

With continuing reference to FIG. 5, shown is main rotor 11 of rotary assembly 10. Rotary assembly 10 also includes main rotor 11, arcuate slope 12 and cylindrical hollow portion 13 in which torsion bar (or rod) 14 is located. Main rotor 11 is the main body of rotary assembly 10. Main rotor 11 has cylindrical hollow portion 13 extending transversely to strings 3. Torsion bar 14 extends coaxially through hollow portion 13 of main rotor 11 between left frame bracket 6 (not shown in FIG. 5) and right frame bracket 7. As discussed below, one end of torsion bar 14 extends into right frame bracket 7, to which torsion bar 14 is affixed by threaded pin 16. Right frame bracket 7 may include a reciprocal cylindrical hollow portion, similar to cylindrical hollow portion 13, into which torsion bar 14 extends. The other end of torsion bar 14 extends into left frame bracket 6; this end of torsion bar 14 is not affixed to left frame bracket 6, instead being rotatably supported in left frame bracket 6. Since torsion bar 14 is affixed to right frame bracket 7, exerting a downward force on tremelo arm 18 rotates main rotor 11, and remainder of rotary assembly 10, around torsion bar 14 in direction shown by arrow in FIG. 5.

Figure 6:
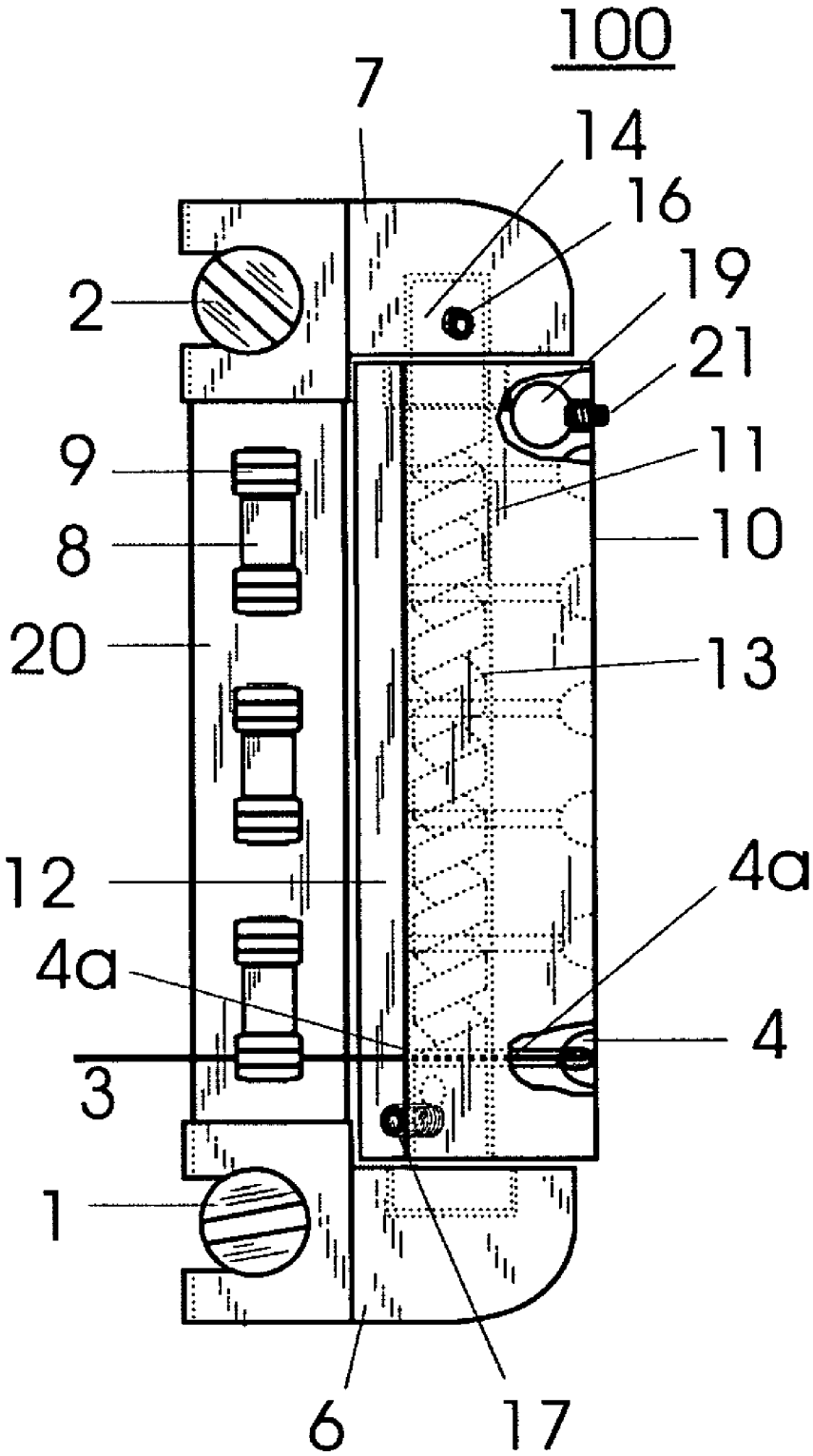
FIG. 6 is a plan, partially cross-sectional view of an embodiment of an improved tremolo mechanism.

With reference now to FIG. 6 shown is a plan, partial cross-sectional view of an embodiment of improved tremolo mechanism 100. Shown in this view, tremolo mechanism 100 comprising two frame brackets 6, 7 containing rotary assembly 10 and attached to stud screws 1, 2 along with a press plate 20. Guitar string 3 end is inserted into fixing hole 4, which holds guitar string 3 in place as string 3 exits through exit holes 4*a* over arcuate slope 12 and under tension roller 9, which is affixed to press plate 20 via bracket 8. Main rotor 11 is fastened to torsion bar 14 with threaded pin 17. As discussed above, torsion bar 14 is affixed to right frame bracket 7 with threaded pin 16 while being rotatably supported by left frame bracket 6. Left frame bracket 6 may also include a cylindrical hollow portion and ball bearings, or other similar known mechanism, for supporting torsion bar 14 and allowing torsion bar 14 to rotate while maintaining its position in left frame bracket 6. Since main rotor 11 is affixed to torsion bar 14 at one end, main rotor 11 rotates around torsion bar 14 due to torsion bar 14 being affixed to frame bracket 7 when tremelo arm 18 is pressed downward. A torsion effect is created in torsion bar 14 when main rotor 11 rotates as such, biasing main rotor 11 in direction rotational direction (i.e., towards rear of main rotor 11—where fixing holes 4 located). Tremolo arm 18, which is inserted into tremolo hole 19, can be tightened with threaded pin 21 in order to restrict the sideway movement of tremolo arm 18.

Right and left frame brackets 6, 7 may be formed as one unit with press plate 20, and may be mounted onto guitar body 5 (not shown in FIG. 6) with existing tailpiece stud screws 1, 2.

Figure 7:
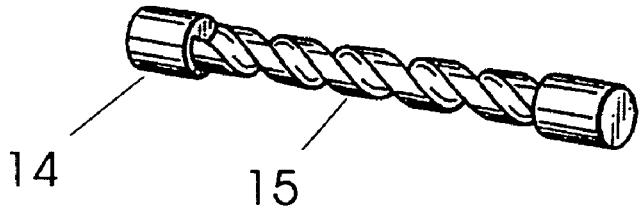
FIG. 7 is a perspective view of a rotary shaft of an embodiment of an improved tremolo mechanism.

With reference now to FIG. 7, shown is a perspective view of torsion bar 14 of an embodiment of tremolo mechanism 100. Torsion bar 14 acts as a rotary shaft of tremolo mechanism 100, specifically rotary assembly 10. Torsion bar includes one or more spiral or helical groove 15 that extends from near one end of torsion bar 14 to near the other end. This enables torsion bar 14 to twist but provides opposing force thereto. A torsion effect is achieved when torsion bar 14 is twisted in either direction of its center axis while fixed in place at on end as described above. Main rotor 11 twists with one end of torsion bar 14, rotating in direction shown in FIG. 5, when downward force applied to tremolo arm 18.

Figure 8:
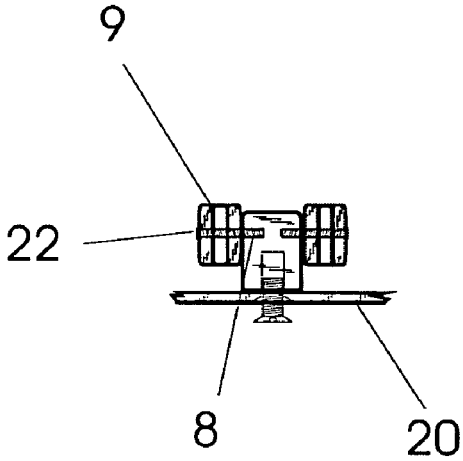
FIG. 8 is a cross-sectional side elevation view of a secondary rotary shaft of an embodiment of an improved tremolo mechanism.

With reference now to FIG. 8, shown is an elevated front view of a portion of press plate 20 showing two tension rollers 9 connected to bracket 8 via one or more shafts 22 in an embodiment of tremolo mechanism 100. Tension rollers 9 rotate around shaft(s) 22. Shaft(s) 22 affix tension rollers 9 to bracket 8 which is fastened to press plate 20 (e.g., via screw). Each tension roller 9 is a tension roller for a guitar string 3 that acts to tighten the tension in guitar string 3 when guitar string 3 is pressed, e.g., by a finger.

Figure 9:
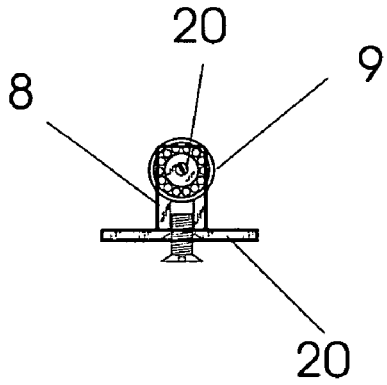
FIG. 9 is a schematic elevated front view of a secondary rotary shaft of an embodiment of an improved tremolo mechanism.

With reference now to FIG. 9, shown is a cross-section side view of a tension roller 9 and bracket 8 on press plate 20 of an embodiment of tremolo mechanism 100. As noted above, tension roller 9 rotates around shaft 22 and is affixed to bracket 8 which is fastened to the press plate 20.

Figure 10:
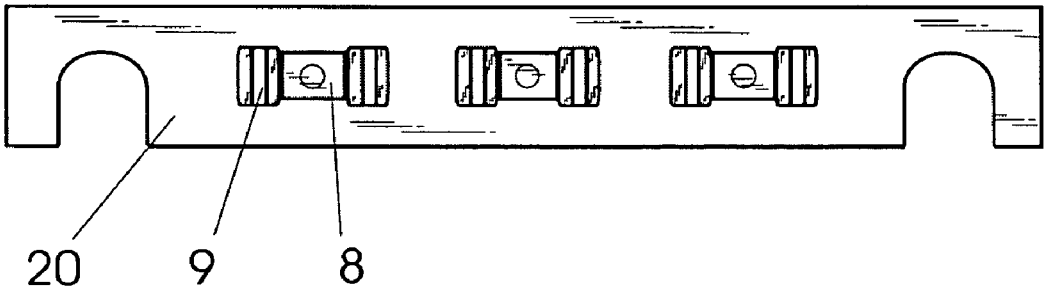
FIG. 10 is a plan view of a press plate of an embodiment of an improved tremolo mechanism.

With reference now to FIG. 10, shown is a plan view of press plate 20 of an embodiment of tremolo mechanism 100. As shown, press plate 20 includes three brackets 8 to which two tension rollers 9 each are attached.

Figure 11:
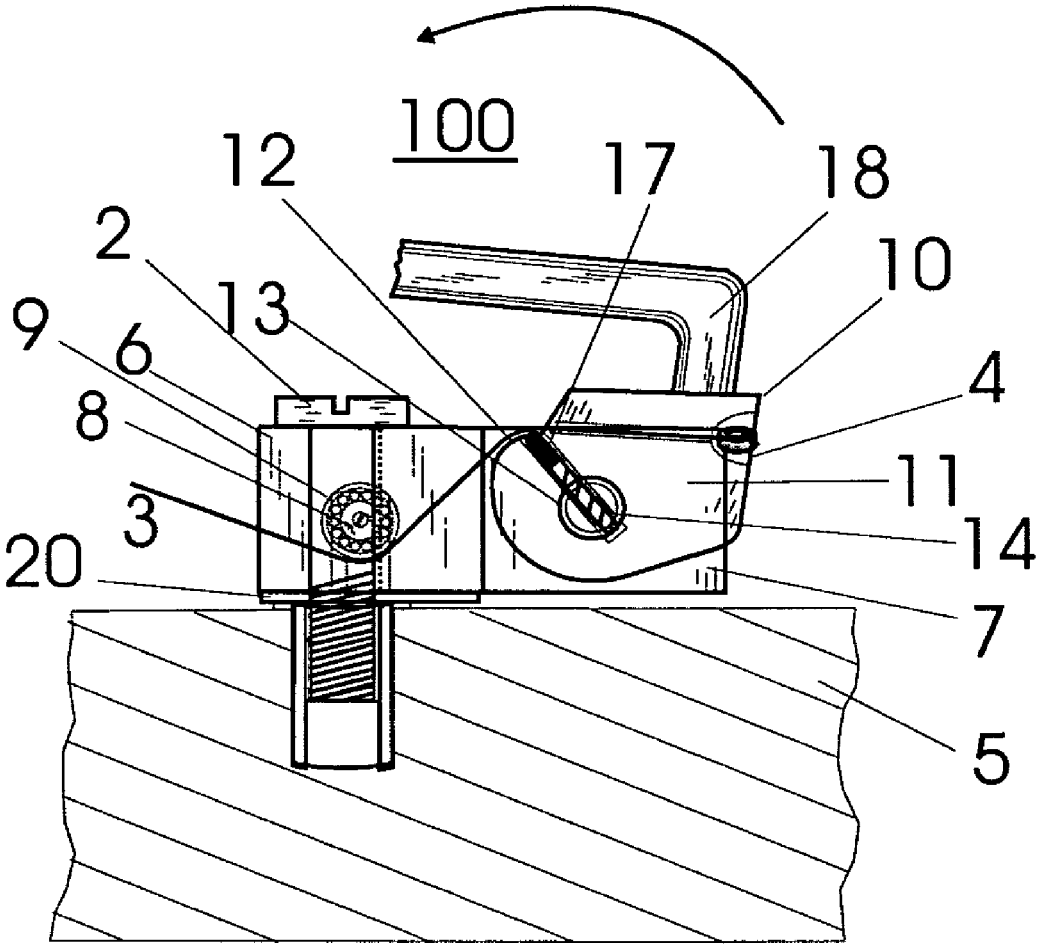
FIG. 11 is a cross-sectional side elevation view of an embodiment of an improved tremolo mechanism.

With reference now to FIG. 11, shown is another cross-sectional side view of an embodiment of improved tremolo mechanism 100. FIG. 11 shows tremolo mechanism 100 from the opposite side shown in FIG. 5. As described above, tremolo mechanism 100 is attached to a guitar body 5 via stud screw 1 and stud screw 2 (not shown in FIG. 11). Guitar string 3 is inserted into a fixing hole 4 in rotary assembly 10. Guitar string 3 exits out the front of rotary assembly 10 (via exit hole 4*a*) traversing arcuate slope 12 and is threaded under tension roller 9 which is attached to press plate 20 via bracket 8. As discussed above, rotary assembly 10 includes torsion bar 14 that is affixed on first end to frame bracket 7 with threaded pin 16 (not shown in FIG. 11) and affixed on opposite, second end with threaded pin 17 to main rotor 11, as shown in FIG. 11. Consequently, when downward force is exerted on tremolo arm 18, rotary assembly 10 rotates in the direction of the arrow.

Figure 12A:
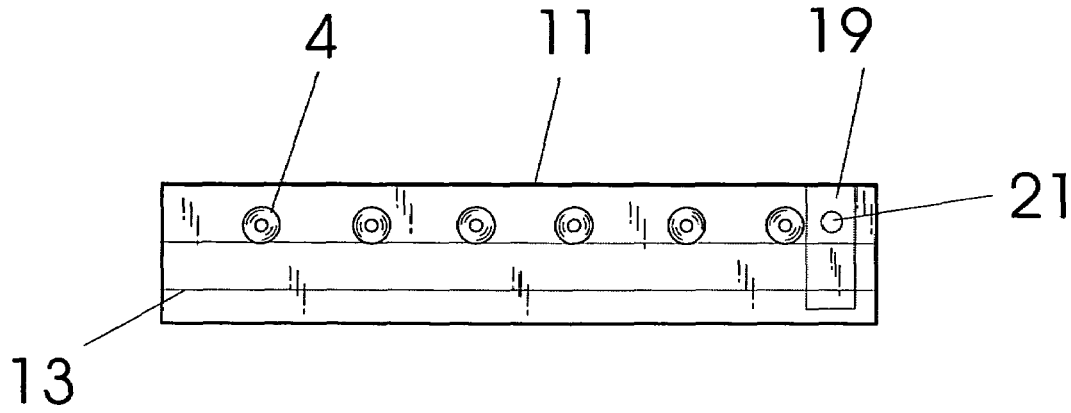
FIGS. 12A-12C are various views of an embodiment of a torsion bar of an embodiment of an improved tremolo mechanism.
Figure 12B:
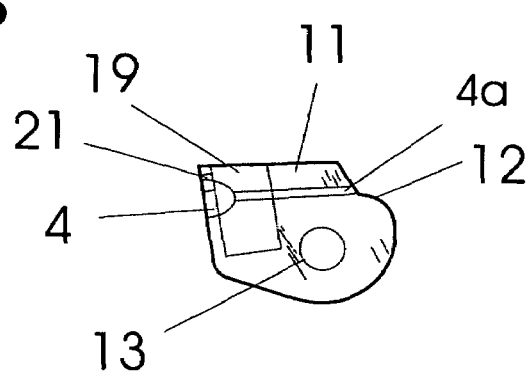
Figure 12C:
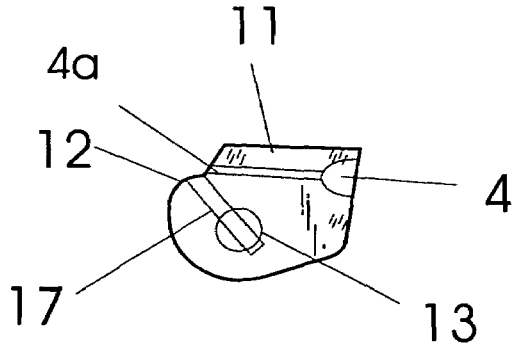

With reference now to FIGS. 12A-12C, shown is main rotor 11 of rotary assembly 10. As discussed above, main rotor 11 has cylindrical hollow portion 13 extending transversely to strings 3. Torsion bar 14 (not shown in FIGS. 12A-12C) extends coaxially through hollow portion 13 of main rotor 11 between left frame bracket 6 and right frame bracket 7 (not shown in FIGS. 12A-12C). One end of main rotor 11 is supported rotatably on torsion bar 14, while the other end is affixed to torsion bar 14 by pin 17. This allows main rotor 11 (and, hence, rotary assembly 10) to freely rotate around torsion bar 14.

Figure 13:
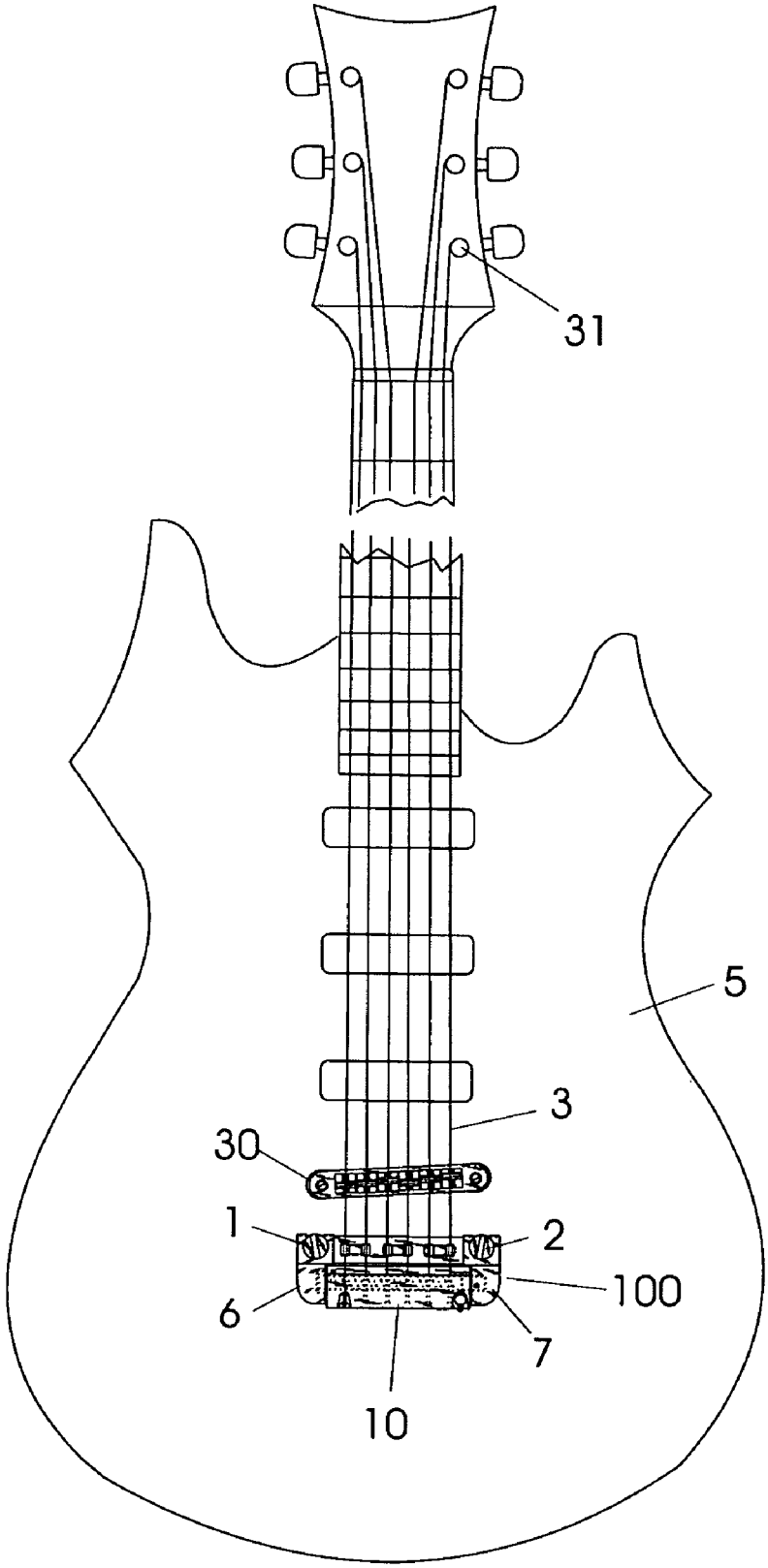
FIG. 13 is a plan view of a guitar body that includes an embodiment of an improved tremolo mechanism.

With reference now to FIG. 13, shown is a plan view of guitar body 5 with an embodiment of tremolo mechanism 100 attached thereto. As shown, tremolo mechanism 100 is installed in place of the standard style tailpiece (not shown). Tremolo mechanism is attached to stud screws 1,2 via frame brackets 6, 7. Guitar strings 3 are affixed to tremolo mechanism 100 (e.g., fixing holes in rotary assembly 10), are stretched over a standard guitar bridge 30 and continue along the length of guitar body 5 to individual tuning pegs 31, to which the guitar strings 3 are attached.

In operation, tremolo arm 18 can give a tremolo effect while playing the guitar by pressing it down (e.g., by hand). Its clockwise rotation can be tightened by a threaded pin 21 inserted between the lower butt of tremolo arm 18 and the back of main rotary shaft 11.

When tremolo arm 18 is pressed down toward guitar body 5, main rotor 11 rotates causing torsion bar 14 to twist. When force is removed from tremolo arm 18, torsion bar 14 will act resiliently to restore tremolo arm 18 (and, hence, rotary assembly 10) to its original position. Since torsion bar 14 has grooves cut into its outer circumference, the stresses developed in torsion bar 14 when a rotational force is applied to it are parallel to the direction of the grooves. The stresses are therefore close to the tensile stresses in the same direction, which greatly increases the elastic limit of torsion bar 14. Accordingly the spring used in a conventional tremolo mechanism is not needed, and the stroke of the tremolo arm is increased, so that when a large stroke is used, the tremolo will always arm return to its original position.

When tremolo arm 18 is pressed down, rotary assembly 10 releases the tension in strings 3 without friction due to the rolling action of tension rollers 9 which guide the strings 3 to a standard bridge 30 and along the length of the guitar body 5 to the tuning pegs 31 thereby decreasing the pitch of the strings 3. When tremolo arm 18 is released, rotary assembly 10 returns the strings 3 to their original tension, thus producing a tremolo effect.

While it is intended that the tremolo mechanism be used with a guitar, embodiments may be installed on and used with other string instruments. Furthermore, the guitar may be any type of guitar whether presently conceived of or not.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

The invention claimed is:

1. A tremolo mechanism for a guitar comprising:

a rotary assembly comprising:

a main rotor that includes an arcuate shaped surface proximate holes through which a plurality of guitar strings exit the main rotor when the tremolo mechanism is installed on a guitar;

resilient means coupled to said main rotor to bias said rotary assembly to a first position at which no tremolo effect is provided and away from a second position at which a tremolo effect is provided;

fixing means on the main rotor for securing one end of each of the plurality of guitar strings to the rotary assembly;

a plurality of tension rollers for providing rotational tension to said guitar strings, wherein said arcuate shaped surface directionally guides said strings transverse of said rotary assembly to the tension rollers; and a press plate for holding said main rotor and said tension rollers above a surface of a guitar when the tremolo mechanism is installed on said guitar.

2. The tremolo mechanism of claim 1 further comprising a tremolo arm extending at an angle from a rotational axis of rotary assembly and adapted to extend away from said guitar surface, wherein force exerted on said tremolo arm rotates said rotary assembly to the second position.

3. The tremolo mechanism of claim 2 wherein said tremolo arm is mounted in a mounting hole provided on said main rotor and wherein said tremolo arm rotation can be limited by a set screw affixed through main rotor.

4. The tremolo mechanism of claim 1, wherein said resilient means comprises a torsion bar having its axis in parallel with a rotational axis of the rotary assembly.

5. The tremolo mechanism of claim 4, wherein said main rotor comprises a hollow bore which accommodates therein said torsion bar positioned coaxially with said rotational axis.

6. The tremolo mechanism of claim 4 further comprising a first bracket and a second bracket on an opposite side of the tremolo mechanism from the first bracket, wherein the first bracket and the second bracket may be used to secure the tremolo mechanism to a guitar, and wherein a first end of the torsion bar is fixably coupled to the first bracket, a first end of the main rotor rotates freely about the torsion bar, a second end of the torsion bar is rotatably supported by the second bracket, and a second end of the main rotor is fixably coupled to the torsion bar.

7. The tremolo mechanism of claim 4, wherein said torsion bar includes a groove formed therein and extending helically along length and around periphery of said torsion bar.

8. The tremolo mechanism of claim 1 further comprising a press plate, wherein the torsion rollers are affixed to the press plate.

9. A guitar comprising the tremolo mechanism of claim 1.

10. A tremolo mechanism for a string instrument comprising:

a rotary assembly comprising:

a main rotor that defines holes through which a plurality of strings exit the main rotor when the tremolo mechanism is installed on a string instrument;

a torsion bar coupled to said main rotor to bias said rotary assembly to a first position at which no tremolo effect is provided and away from a second position at which a tremolo effect is provided; and fixing holes defined by rear of the main rotor for securing one end of each of the plurality of strings to the rotary assembly; and a plurality of tension rollers for providing rotational tension to said strings, wherein said main rotor directionally guides said strings transverse of said rotary assembly to the tension rollers; and a press plate with a holding area for holding said main rotor and said tension rollers above a surface of a string instrument when the tremolo mechanism is installed on said string instrument.

11. The tremolo mechanism of claim 10 further comprising a tremolo arm extending at an angle from a rotational axis of rotary assembly and adapted to extend away from said string instrument surface, wherein force exerted on said tremolo arm rotates said rotary assembly to the second position.

12. The tremolo mechanism of claim 10, wherein said main rotor comprises a hollow bore which accommodates therein said torsion bar positioned coaxially with said rotational axis.

13. The tremolo mechanism of claim 10 further comprising a first bracket and a second bracket on an opposite side of the tremolo mechanism from the first bracket, wherein the first bracket and the second bracket may be used to secure the tremolo mechanism to a string instrument, and wherein a first end of the torsion bar is fixably coupled to the first bracket, a first end of the main rotor rotates freely about the torsion bar, a second end of the torsion bar is rotatably supported by the second bracket, and a second end of the main rotor is fixably coupled to the torsion bar.

14. The tremolo mechanism of claim 10 wherein said torsion bar includes a groove formed therein and extending helically along length and around periphery of said torsion bar.

15. The tremolo mechanism of claim 10, wherein the torsion rollers are affixed to the press plate.

16. A guitar comprising the tremolo mechanism of claim 10.

17. A guitar capable of producing a tremolo affect comprising:

a guitar body;

a plurality of guitar strings;

a plurality of tuning pegs;

a guitar bridge;

an improved tremolo mechanism comprising:

a rotary assembly comprising:

a main rotor that defines holes through which the plurality of guitar strings exit the main rotor;

a torsion bar coupled to said main rotor to bias said rotary assembly to a first position at which no tremolo effect is provided and away from a second position at which a tremolo effect is provided;

fixing holes defined by rear of the main rotor for securing one end of each of the plurality of guitar strings to the rotary assembly;

a plurality of tension rollers for providing rotational tension to said guitar strings, wherein said main rotor directionally guides said guitar strings transverse of said rotary assembly to the tension rollers and wherein said guitar strings are stretched over the guitar bridge and continue along the length of the guitar body to the plurality of tuning pegs; and a press plate with a holding area for holding said main rotor and said tension rollers above a surface of said guitar when the tremolo mechanism is installed on said guitar.

18. The guitar of claim 17 wherein the tremolo mechanism further comprises a tremolo arm extending at an angle from a rotational axis of rotary assembly and adapted to extend away from said guitar surface, wherein force exerted on said tremolo arm rotates said rotary assembly to the second position.

19. The tremolo mechanism of claim 17 further comprising a first bracket and a second bracket on an opposite side of the tremolo mechanism from the first bracket, wherein the first bracket and the second bracket may be used to secure the tremolo mechanism to the guitar body, and wherein a first end of the torsion bar is fixably coupled to the first bracket, a first end of the main rotor rotates freely about the torsion bar, a second end of the torsion bar is rotatably supported by the second bracket, and a second end of the main rotor is fixably coupled to the torsion bar.

* * * * *